US006487492B1

(12) United States Patent
Loucks

(10) Patent No.: US 6,487,492 B1
(45) Date of Patent: Nov. 26, 2002

(54) FUEL BUCKET SCHEDULER

(75) Inventor: Charles Hamilton Loucks, Ann Arbor, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/634,617

(22) Filed: Aug. 5, 2000

(51) Int. Cl.[7] ..... F02D 41/26
(52) U.S. Cl. ..... 701/104; 123/480; 123/481
(58) Field of Search ..... 701/103–105; 123/481, 480

(56) References Cited

U.S. PATENT DOCUMENTS 5,732,381 A * 3/1998 Guido et al. ..... 701/104
6,223,119 B1 * 4/2001 Akasaka et al. ..... 701/104

* cited by examiner

*Primary Examiner*—Andrew M. Dolinar

(57) ABSTRACT

A fuel control system for an internal combustion engine includes a processor for determination of the timing and length of control pulse signals to an injector driver for turning an injector on and off. The method and an apparatus for delivering fuel to the injectors is according to a schedule that is adjusted throughout a variety of operating conditions with a minimum of chronometric or throughput loading by scheduling a circular queue of a plurality of buckets determined as a predetermined portion of a combustion cycle. Each bucket is defined by an interval initiated by an event triggered interrupt. At the interrupt, the processor dequeues a list of pointers to fueling information data storage for each cylinder previously assigned to the bucket. The method then assigns each cylinder to at least one selected bucket according to predetermined logic determination and an injector demand signal.

9 Claims, 3 Drawing Sheets

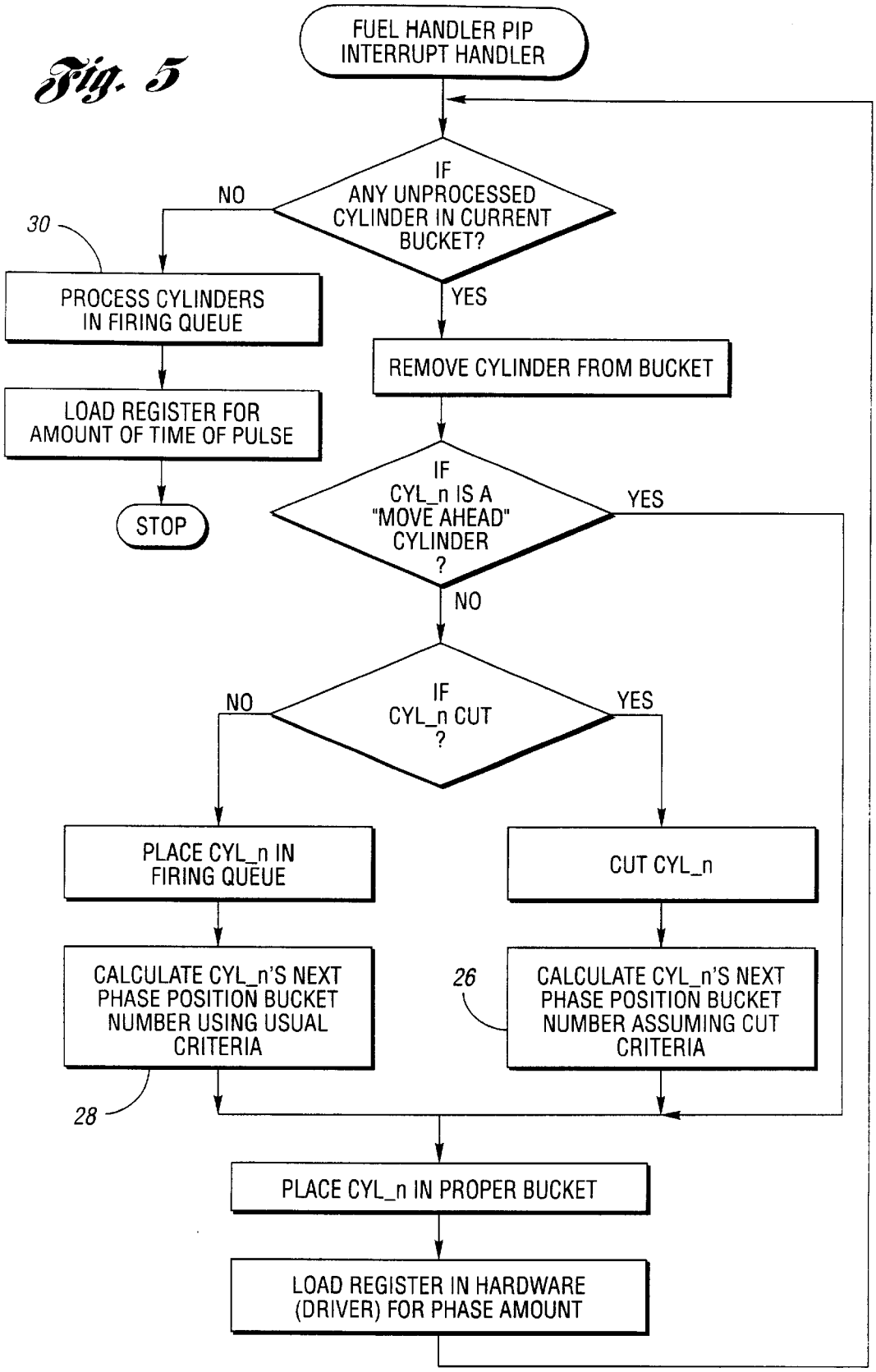
Fig. 5
FUEL HANDLER PIP INTERRUPT HANDLER
IF ANY UNPROCESSED CYLINDER IN CURRENT BUCKET?
NO
YES
30
PROCESS CYLINDERS IN FIRING QUEUE
LOAD REGISTER FOR AMOUNT OF TIME OF PULSE
STOP
REMOVE CYLINDER FROM BUCKET
IF CYL_n IS A "MOVE AHEAD" CYLINDER ?
YES
NO
IF CYL_n CUT ?
NO
YES
PLACE CYL_n IN FIRING QUEUE
CUT CYL_n
CALCULATE CYL_n'S NEXT PHASE POSITION BUCKET NUMBER USING USUAL CRITERIA
26
CALCULATE CYL_n'S NEXT PHASE POSITION BUCKET NUMBER ASSUMING CUT CRITERIA
28
PLACE CYL_n IN PROPER BUCKET
LOAD REGISTER IN HARDWARE (DRIVER) FOR PHASE AMOUNT

FUEL BUCKET SCHEDULER

TECHNICAL FIELD

The present invention relates to a fuel control for motor vehicle internal combustion engine systems in which a vehicle control system employs a fuel bucket scheduler operating in a circular queue segmented by a link list to reduce throughput without affecting firing order by dequeueing a link list for each bucket and recalculating phase and bucket number for each injector in a bucket.

BACKGROUND ART

Previously known fuel control systems have become more complicated as the number of inputs to which the scheduler responds multiplies the processing calculations required to generate timely control signals to the injector drivers. For example, some of the injectors for particular cylinders may be cut under certain operating conditions, like during cornering in a racing car or when a cut command is initiated as a response to a traction control system attempting to control the application of torque to a drive shaft, a wheel or the like. Moreover, when cylinders (i.e., injectors) have been cut, the operation of each cylinder may be affected by a phenomena such as boundary,layer depletion that may require a response such as wall wetting to reestablish normal fuel load conditions in a cylinder. For example, an injector may need to be turned on prior to its usual turn-on time so that the cylinder walls can be wet to restore the usual fuel conditions in the cylinder before firing the mixture in the cylinder.

Since the cylinders follow a particular firing order, a large quantity of information may need to be processed for maintaining proper operation of the cylinders before timely turn-on pulses in control signals are sent to the injector drivers under all of the operating conditions encountered by the vehicle and the vehicle control system. The previously known fuel control systems were not set up to minimize processing time or processing throughput for the multiple changing controls required for each of the injectors, particularly as the number of cylinders to be controlled are increased in an engine.

DISCLOSURE OF INVENTION

The present invention overcomes the above-mentioned disadvantages by providing a method and apparatus for delivering fuel to the injectors of an internal combustion engine according to a schedule that is adjusted throughout a variety of operating conditions with a minimum of chronometric or throughput loading. The method schedules a circular queue of a plurality of buckets defining a predetermined portion of a combustion cycle. Each bucket is defined by a combustion cycle interval and initiated by an event triggered interrupt (PIP). A combiner, for example, a linked list of pointers to a fueling information data storage sorts the cylinders in the buckets. An assigner designates cylinders as assigned to each bucket according to a predetermined logic determination and to an injector demand signal.

In a preferred embodiment, the number of buckets is selected as the number of cylinders firing within one firing sequence, for example, throughout a 720° crankshaft rotation for a four cycle engine. The preferred embodiment may also be set up so that the link list normally assigns a cylinder to each bucket. Each bucket is initiated by the fuel scheduler PIP interrupt handler in which the link between the cylinder and the bucket is dequeued for processing of the cylinder for the next combustion cycle event. Nevertheless, the firing order remains intact because only the cylinders assigned to the bucket are processed for generating injector controls, for example, as to the phase for initiating firing of the injector within the bucket and the number of the bucket in which the firing is to occur, before a length of pulse or other demand signal is applied for the firing order in the queue. Accordingly, only a limited amount of information is processed at one time.

Moreover, such a processing can be handled in a short time without affecting the firing queue of the cylinder, enabling the link list to be requeued in the same firing order cycle. The cylinder is processed in the firing queue to change the length of the control pulse to the fuel injector in response to operating parameters, such as current air/fuel ratio, precalculated air/fuel values or the like. Once the phase of pulse initiation and pulse length due to demand have been determined, the figures are input to an injector driver, for example, by loading hardware registers in the driver, to control the operation of the injector or injectors at each cylinder.

BRIEF DESCRIPTION OF DRAWINGS

The present invention will be more clearly understood by reference to the following detailed description of a preferred embodiment of the present invention when read in conjunction with the accompanying drawing, in which like reference characters refer to like parts throughout the views, and in which:

FIG. 5 is a flow diagram of a fuel scheduler algorithm operating in accordance with the present invention.

BEST MODE FOR CARRYING OUT THE INVENTION

Figure 1:
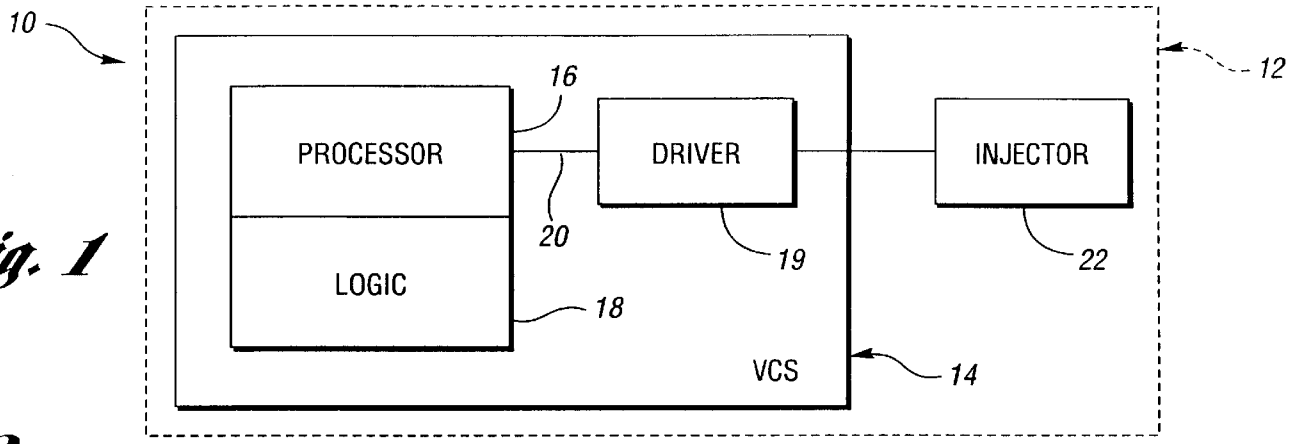
FIG. 1 is a block diagram of a fuel control system for an internal combustion engine according to the present invention.

As shown in FIG. 1, a fuel control system 10 for an internal combustion engine 12 is shown comprising a vehicle control system 14 including a processor 16 and logic 18 that controls the injector driver 18 in response to numerous inputs of fact control and defined engine operation. Although the present invention may be used as part of an engine electronic control module or other similar system, the vehicle control system 14 of the present invention houses numerous control circuits for numerous vehicle operating systems in a reduced size package that employs digital and analog communication busses for compact interconnection and communication of numerous circuit boards. Regardless of the physical arrangement of the control circuits, conventional electronic control modules for engine operation may provide a suitable platform for the present invention. Similarly, the driver may be part of a previously known injector and driver systems, although in the preferred embodiment, a hardware driver, for example, in a powertrain electronic controller module, includes registers that receive data signals from the processor and deliver control pulses to the injector 22. Each injector 22 is associated with a cylinder, although it will be understood that the present invention may also be employed with the cylinders having multiple injectors or injectors of substantially different structures.

Figure 2:
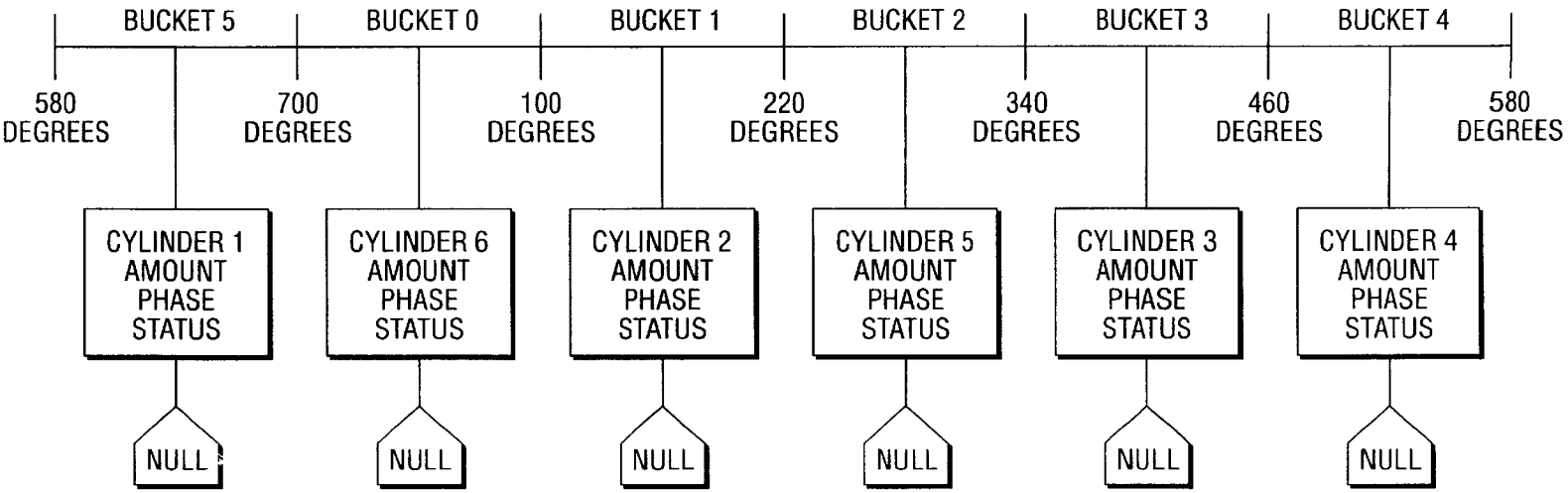
FIG. 2 is a data structure diagram identifying a plurality of buckets and link lists arranged in an operating condition according to the present invention.

Referring now to FIG. 2, a series of pulse signals are shown representing the control pulses 20 sent to the driver 18 based on the calculations occurring at the processor 16. In the preferred embodiment, six signals are sent to six injectors for each of six cylinders in a six cylinder engine, the relation between the pulses as shown on a time basis, for example, where the firing order of the cylinders is 1-6-2-5-3-4. It is to be understood that the invention is not limited to the number of cylinders, nor the particular firing order shown.

For the sake of demonstration, assume that a power drop is required in response to a traction control system, a cornering sensor or the like. A control pulse operable for cylinder six may be cut as shown diagrammatically by the shaded area 24 in FIG. 3. Morever, after cutting, a compensatory response may demand early reinstatement of fuel injection to provide rewetting of the cylinder walls at a time prior to the usual turn-on time of fuel as shown at the crosshatched area 26 in FIG. 3. A response to these types of changes is graphically illustrated in the data structure shown in FIGS. 2 and 4.

As shown in FIG. 2, a data structure represents a number of buckets 0, 1, 2, 3, 4, and 5 one bucket being assigned for each of the cylinders in the engine in the preferred embodiment to limit the number of processing sequences in the firing order. It will be understood that any number of buckets may be used provided that each bucket defines an interval of the firing cycle. In the preferred embodiment, the firing cycle is 720°, as may be typically referred to as four cycle operation in which a crankshaft rotates twice, i.e., throughout 720°, for each four stroke operation of each piston in each cylinder. Each bucket is initiated by a processing interrupt (PIP). It is to be understood that the number of the bucket need not be consistent with the number of the cylinder in so far as the bucket arrangement is a circular queue throughout the 720° firing cycle.

Figure 3:
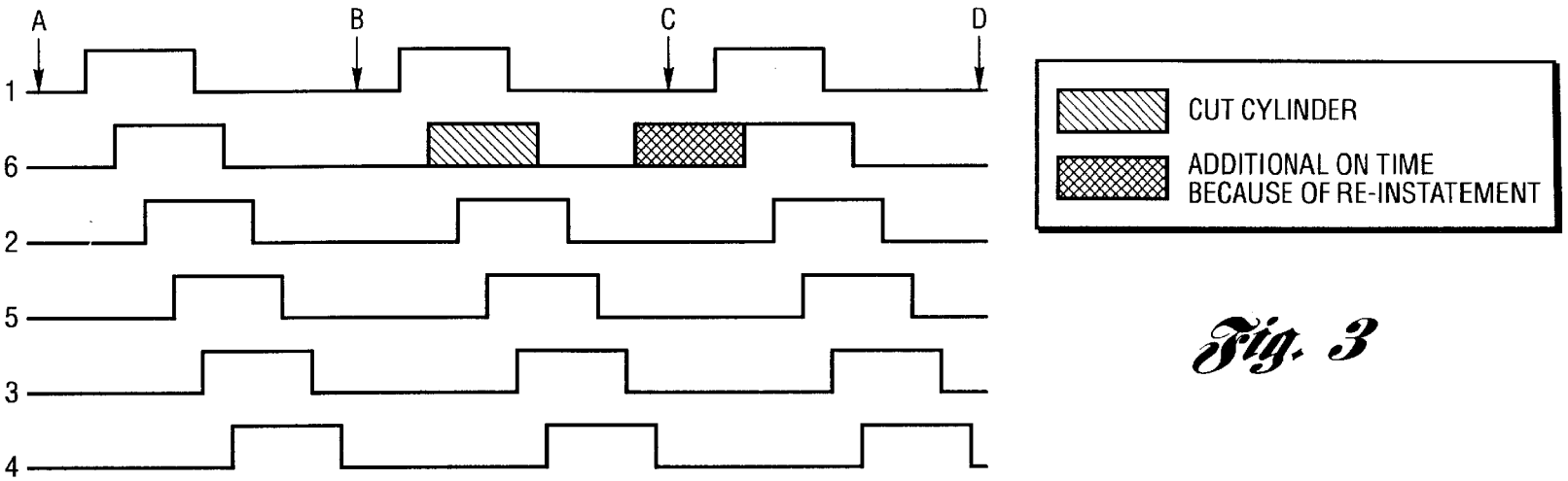
FIG. 3 shows a series of injector drive pulses in relation to each other as may be required to adjust the fuel control according to operating conditions of the engine.
Figure 4:
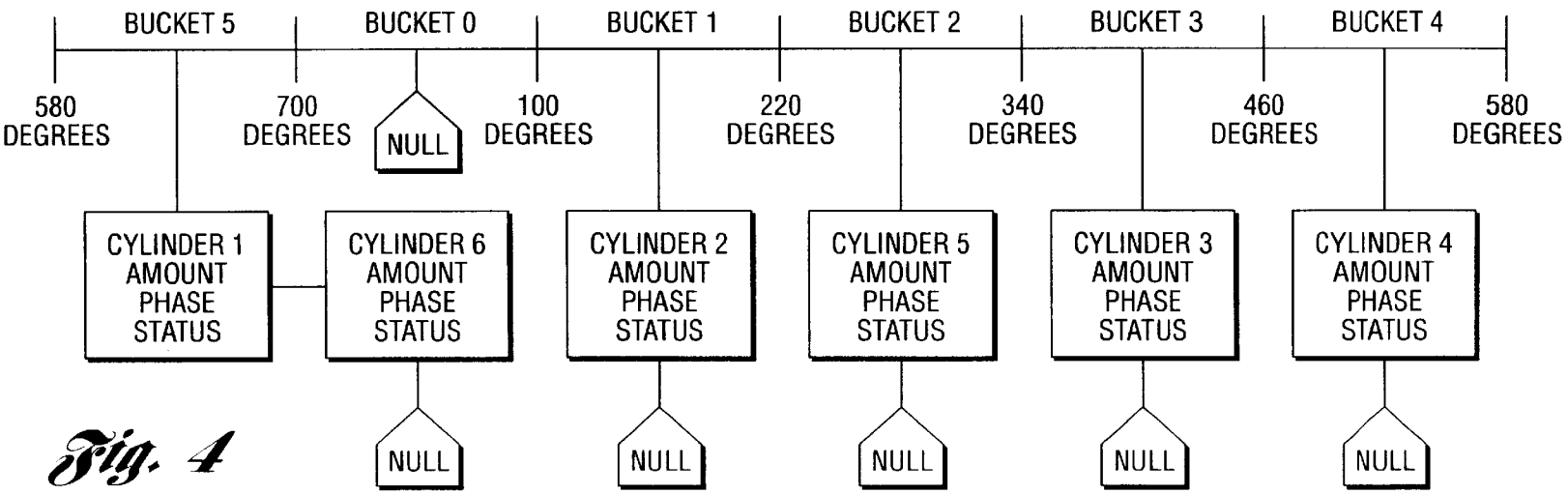
FIG. 4 is a data structure diagram similar to FIG. 2 but showing a modified link list according to portions of the diagram shown in FIG. 3.

As shown, a cylinder is assigned to each bucket by a predetermined logic and aims or points to a particular cylinder for operation in that bucket, for example, as shown at the positions shown at A, B and D in FIG. 3. This data structure forms the basis for the algorithm implementation used in practicing the method with the apparatus of the present invention. The circular queue of buckets is combined, preferably with a linked list of pointers to individual data stores for cylinder fueling information. However, other combiners, such as an array field, may also be employed although currently at much greater expense. These stores include information such as the amount, phase, cut status, etc., of the injector to be operated. The degree range interval, or bucket, starts at the earliest possible reference or PIP event location and ends at the start of the next PIP that initiates a following bucket in the firing queue. This arranging allows the start of injection for a given injector to be efficiently placed anywhere during an engine cycle, according to a position dependent equation discussed below. The algorithm that processes the data structure is shown in FIG. 5.

As shown in FIG. 5, at the occurrence of a PIP event, and after the current bucket position for a cylinder (i.e., injector) has been determined, the linked list is dequeued from the bucket by traversing the linked list until a null value is encountered. Each cylinder in the bucket is dequeued, and each cylinder is processed sequentially for the bucket. First the processor checks to see if the cylinder is cut. If the cylinder is cut, the cylinder is assigned a zero value pulse length when placed in the firing queue. A calculation for the current cylinder's next phase position and bucket number is calculated assuming normal run criteria. For example, as shown in FIG. 20, if the cylinder is cut, the processor zeros out the current cylinders fuel amount, for example, an input to a resister at 30, and calculates the next phase position and bucket number as shown at 26 assuming the cut cylinder criteria.

If the cylinder is not cut, the cylinder is placed in the firing queue 30, and the next phase position and bucket number are determined using the usual criteria. The usual criteria, as shown at A, B and D in FIG. 2, is not the early reinstatement response shown at C in FIG. 2.

Regardless of the cut or not cut condition, the bucket number B is determined by the equation: B=[(Pos+ENG_CYCLE—BO) Mod ENG_CYCLE] Div PIP_PERIOD where: Pos=Desired Degree Position To Turn On Injector (Such Counts Are Normally Determined With Respect To T.D.C. (TOP Dead Center Piston Position) but an absolute value designation loaded into the hardware register in driver 18)

ENG_CYCLE=Number of Degree Counts Per Engine Cycle,

BO=Bucket Zero PIP or Reference Position in Degree Counts,

PIP_PERIOD=ENG_CYCLE/Number_of_Cylinders,

Mod=Integer Modulo Divide, and

Div=Integer Divide.

As a particular example, at Pos=300°, Eng_Cycle=720°, Bo=700°, and Pip_Period=120°,

[(300°+720°−700°) MOD 720°]/120°

(320°% 720)/120°

320°/120°=2=B

Pos may be larger than a multiple of the engine cycle. Only the Pos value, normally selected with respect to top dead center (TDC) position of the piston in the cylinder, will be changed in each box 28 and 29. Nevertheless, an absolute number may also be employed without departing from the invention.

Third, requeue all dequeued cylinders. With the PIP intervals appropriately spaced, requeueing that queue well before the firing if the queue demand is required within the bucket.

Fourth, the processor calculates the fuel amount for the cylinders logged in the firing queue according to a demand criteria at 30 in FIG. 5. For example, the length of the pulse may be provided as a result of calculations based on current information of the air/fuel ratio, or can be used according to precalculated values as determined by the processor.

While the best mode for carrying out the invention has been described in detail, those familiar with the art to which this invention relates will recognize various alternative designs and embodiments for practicing the invention as defined by the following claims.

What is claimed is:

1. A method for delivering fuel to a plurality of cylinders of an internal combustion engine via at least one injector according to a schedule that is adjusted throughout a variety of operating conditions with a minimum of chronometric or throughput loading, the method comprising:

scheduling a circular queue of a plurality of buckets, each bucket defining a predetermined portion of a combustion cycle, each bucket being defined by an interval initiated by an event triggered interrupt;

combining a linked list of a plurality of data cells connected by pointers, said cells holding a fueling data storage for at least one of said plurality of cylinders; and assigning at least one of said plurality of cylinders to at least one selected bucket of said plurality of buckets according to a predetermined logic determination and an injector demand signal.

2. The invention as defined in claim 1 wherein said scheduling includes defining said plurality of buckets in a number equal to the number of cylinders in the engine.

3. The invention as defined in claim 1 wherein said combining includes defining said linked list as a function of said assigning during a previous combustion cycle.

4. The invention as defined in claim 1 wherein said assigning an injector demand signal includes sensing a traction control parameter and generating a command signal corresponding to said traction control parameter.

5. The invention as defined in claim 4 wherein said sensing comprises detecting a cut cylinder command.

6. The invention as defined in claim 1 and further comprising limiting said linked list assigned to each bucket to a predetermined number less than said plurality of buckets.

7. The invention as defined in claim 6 and comprising determining said predetermined number from a dequeued calculation.

8. The invention as defined in claim 1 wherein said assigning comprises calculating a phase position and the corresponding bucket number using a predetermined criteria.

9. The invention as defined in claim 8 wherein said calculating comprises determining phase position as a function of a demand criteria.

* * * * *